United States Patent [19]

Duron et al.

[11] 4,376,377

[45] Mar. 15, 1983

[54] UNLOADING SYSTEM FOR CRYOGENIC PUMPS

[75] Inventors: Paul P. Duron, Corona Del Mar; Charles E. Tellez, Alta Dena; Robert D. Lutjens, Hacienda Heights, all of Calif.

[73] Assignee: Cryomec, Inc., Anaheim, Calif.

[21] Appl. No.: 250,582

[22] Filed: Apr. 3, 1981

[51] Int. Cl.[3] ..... B01D 8/00

[52] U.S. Cl. ..... 62/55.5; 417/298

[58] Field of Search ..... 62/55.5; 417/298

[56] References Cited

U.S. PATENT DOCUMENTS

| | | | |
|---|---|---|---|
| 2,256,565 | 9/1941 | Mantle | 417/298 |
| 2,925,040 | 2/1960 | Rose | 417/298 |
| 2,962,970 | 12/1960 | Norlin | 417/298 |
| 3,000,319 | 9/1961 | Tuck | 417/298 |

*Primary Examiner*—Ronald C. Capossela
*Attorney, Agent, or Firm*—Knobbe, Martens

[57] ABSTRACT

A multi-cylinder pump for a cryogenic liquid is provided with an unloading system in which the inlet valve of each cylinder can be selectively held open or permitted to close. In the closed position, the operation of the cylinder is normal; while, in the open position, the liquid fails to attain sufficient pressure to exit through the outlet valve, thereby deactivating the cylinder. Preferably, the unloading system comprises several plunger assemblies which may be extended in order to engage the inlet valve and hold it in the open position. Each plunger assembly may be activated by means of a manual thumb screw or in accordance with the change in a pressure differential acting on the plunger. Alternatively, the plunger assembly may be activated electronically by means of a solenoid.

21 Claims, 5 Drawing Figures

Fig. 3
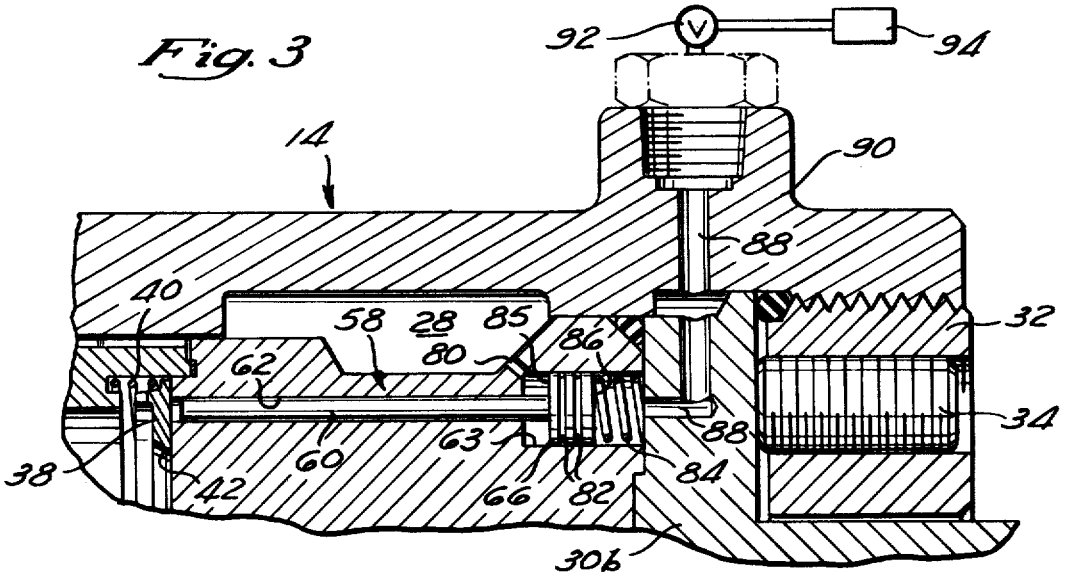
Fig. 4
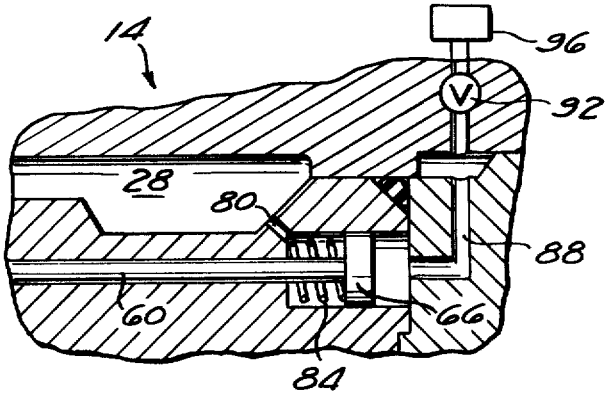
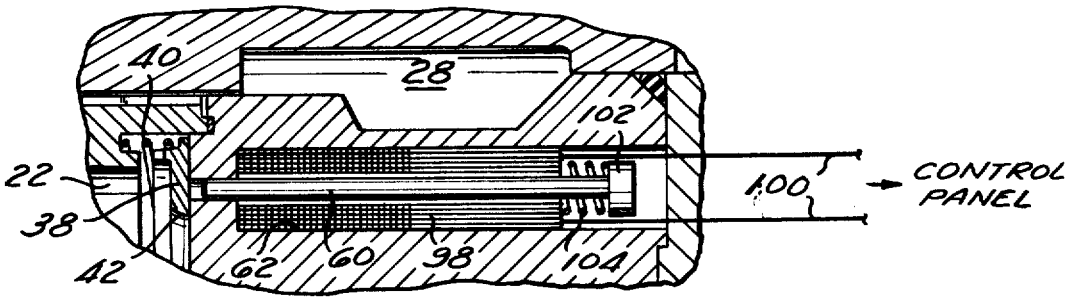
Fig. 5

UNLOADING SYSTEM FOR CRYOGENIC PUMPS

BACKGROUND OF THE INVENTION

Nitrogen gas has many useful industrial applications. For example, it can be used to clean or purge piping systems, chemical plants, or pipelines. Furthermore, nitrogen is clean and can be economically produced. The use of nitrogen is often more advantageous than air since it is denser than air and therefore requires less volume for storage and pressurization purposes. In addition, where there is a danger of fire, nitrogen is preferred over air because it is non-flammable.

The use of nitrogen is particularly important in the oil and gas industry. For example, nitrogen is commonly used in drilling operations for aerating the mud which may be encountered in drilling and in cleaning out the drill stem itself. Nitrogen may also be used in coil tubing work for cleaning out the parafin or other materials which may plug older wells. In order to check drill pipes or well heads for leaks, nitrogen is frequently used to pressurize these devices.

Nitrogen is also directly utilized in the recovery of oil and gas. By a process commonly referred to as "fracturing", the reserves of a new or nearly-depleted oil or gas well can be economically recovered. Under this process, nitrogen and other materials are injected at high pressures into the well in order to force apart the various strata of earth and rock surrounding the well. The oil and/or gas which is trapped within these fractured strata is then forced or permitted to flow by gravity to a well where it can be efficiently pumped or otherwise brought to the surface.

In this fracturing process the nitrogen is typically trucked to the well site in a cyrogenic or liquid state. For offshore drilling operations, the nitrogen may be transported to the well site by barges or boats. The liquid nitrogen is then pumped at a very high pressure into a vaporizer mounted on the transporting vehicle. The vaporizer heats the liquid until it assumes a gaseous state, whereupon the pressurized nitrogen gas is forced into the well in order to accomplish its fracturing function.

The liquid nitrogen is pressurized by large pumps which are also mounted on the transporting trucks. These pumps are specially designed and constructed to withstand the extreme cold temperatures, of liquid nitrogen, which may be as low as 300–400 degrees Farenheit (F.) below zero. Such cryogenic pumps generally comprise an assembly of several pumping cylinders, each having a displacement type piston, valves, and inlet and outlet ports. Thus, for example, each pump may have one or as many as 5 or 6 cylinders, with each cylinder comprising, in effect, an individual pump.

Typically, a "triplex", or three-cylinder pump, is arranged on each side of truck. In operation, all of the cylinders on one side of the truck are simultaneously pumping in parallel. Thus, it is common for the nitrogen to reach a flow rate of more than 100 gallons per minute and pressures of 10,000 to 15,000 pounds per square inch gauge (p.s.i.g.). There are times, however, when the flow rate of the nitrogen must be reduced to such a small amount that it cannot be accomplished by simply reducing the speed of the pump. Under these conditions, it is advantageous to deactivate two of the three cylinders of the pump so that only a single cylinder is operating, thereby permitting more accurate control over the reduced flow of the nitrogen into the well. In the past, this deactivation has been accomplished by diverting the nitrogen flowing from two of the cylinders back into the tank on the truck. Valves on the diversion conduits are opened in order to permit this return flow of the nitrogen to truck, and check valves are utilized to prevent the back-flow from the single operating cylinder into the diversion system.

This type of diversion system, however, suffers from several disadvantages. First, it is quite costly. The diversion conduits and valves are expensive to build and to install. Secondly, the space available on the nitrogen transporting trucks is very limited, due to the large equipment mounted on them and the numerous liquid and electrical conduits. Such a diversion system is bulkly and occupies valuable space that could be more efficiently and economically utilized to accomodate a larger nitrogen tank. Furthermore, the valves and check valves of the diversion system have a limited life and soon develop leaks, especially when subjected to the rapid cycling of the liquid nitrogen flow.

Finally, the return flow of nitrogen back into the tank adds energy to the nitrogen already present. Often times, the nitrogen being pumped out of the tank is at a higher temperature than that in the tank, or it may even be partially or wholly vaporized. Thus, this return flow into the tank heats the existing liquid and often causes it to blow through the tank's relief valve, thereby wasting the nitrogen gas and adding to the cost of the diversion system.

SUMMARY OF THE INVENTION

The unloading system of the present invention provides for the efficient deactivation of the cylinders of a cryogenic pump without the attendant disadvantages of prior diversion systems. In the present unloading system, the inlet valve of each cylinder to be deactivated is prevented from closing during the pressure stroke of pump. Thus, the liquid in the cylinder is cycled in and out through the inlet, rather than through the outlet, thereby eliminating the need for the bulkly conduits and valves of prior diversion systems. In addition, the present unloading system can be successfully utilized in other cryogenic applications, besides fracturing and the oil and gas industry.

As is well known, the inlets and outlet of the cylinders of most pumps (including cryogenic pumps) are provided with valves. During the intake of liquid into the cylinder, the outlet valve is closed in order fill the cylinder. On the other hand, during the pumping of the liquid from the cylinder, the inlet valve is closed in order to permit the pressurization of the liquid and prevent it from exiting through the inlets. In addition, the outlet valve is usually spring-loaded so that the liquid must attain a certain pressure before it can force open the outlet valve and exit from the cylinder.

In the present invention, a series of unloading plunger assemblies can be selectively brought to bear against the inlet valve, thereby preventing it from closing during the pumping stroke of the piston. Thus, the liquid in the cylinder is permitted to exit through the inlet and fails to generate sufficient pressure to open the exit valve.

Preferably, three or more plunger assemblies are equally spaced about the circumference of the circular plate valve, which serves as the inlet valve. Each plunger assembly comprises an unloading rod which is connected at its front end to a piston. The rod is inserted through a bore in the head of the pump so that its rear end is adjacent the inlet valve.

In one embodiment of the present invention, the unloading rod of each plunger assembly is activated manually by an external bolt or thumb screw which is inserted into a threaded shaft in the head. The thumb screw is aligned with the unloading rod and abuts the front end of the piston. Thus, as the screw is advanced, the rear end of the rod bears against the inlet valve and prevents it from closing. By operating all of the thumb screws, the inlet valve will be securely held open and the pump completely deactivated. In addition, the unloading rods are spring-loaded so that as the thumb screws are retracted, the rods return to their initial, retracted position.

In another embodiment, the unloading rod of each plunger assembly is activated by a change in the pressures differential across the unloading piston mounted on the rod. The shaft or bore in which the rod moves is in communication with the inlet annulus of the pump. Thus, the cryogenic liquid on the rear side of the piston is at a pressure which is sufficient to permit it to bleed across the piston and to exit through a vent valve in the head of the pump. If the vent valve is closed, however, the bleeding liquid nitrogen tends to reduce the pressure differential acting on the unloading piston, thereby permitting a spring to activate the rod and causing it to engage and open the inlet valve.

In yet another embodiment of the present invention, the unloading rod of each of the plunger assemblies is electronically activated by a solenoid which surrounds the rod. When the solenoid is energized, the rod, which acts as an armature, advances toward the inlet valve and holds it open. A particular advantage of this unloading technique, as well as the pressure differential technique just described, is that the unloading rod can be activated remotely, such as at the control panel of the liquid nitrogen transporting vehicle.

DESCRIPTION OF THE DRAWING

FIG. 3 is a partial cross sectional view of the cryogenic cylinder of FIG. 2 illustrating the activation of the unloading rod by a pressure differential across the unloading piston;

FIG. 4 is a partial cross sectional view illustrating a variation of the pressure differential technique shown in FIG. 3; and FIG. 5 is another partial cross sectional view illustrating the electronic activation of the unloading by means of a solenoid.

DETAILED DESCRIPTION OF THE INVENTION

Figure 1:
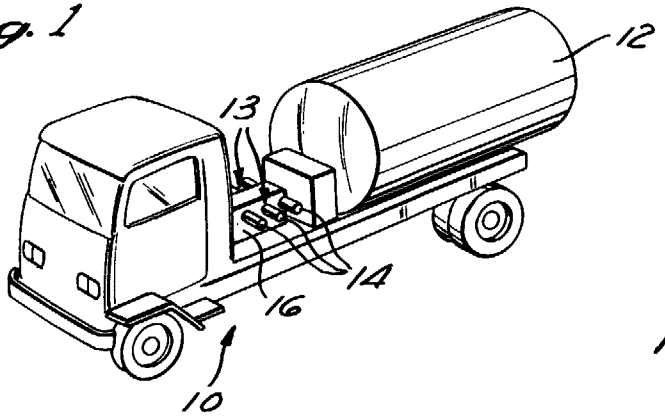
FIG. 1 is a small scale perspective view of a truck used to transport liquid nitrogen to a well site.

FIG. 1 illustrates a typical transporting truck 10 which is utilized in the fracturing of oil and gas wells. However, as mentioned above, other types of transporting vehicles may also be used. The truck 10 comprises a large liquid nitrogen tank 12, mounted at the rear, and two cryogenic pumps 13, mounted on opposite sides, for pumping the nitrogen down into the well. The mobility of the truck 10 permits it to be utilized at various well sites.

The cryogenic pumps 13 are triplex pumps, each having three individual cylinders or pumping units 14, which under most conditions, are simultaneously powered by a single engine 16. For convenience, each pumping unit 14 will be referred to herein as a "pump" 14, but it should be remembered that the present unloading system can be utilized with a pump having one or more pumping units or cylinders.

Sometimes, it is necessary to control the flow rate of the cryogenic pumps 13 at a very reduced rate. Under such circumstances, it is necessary to deactivate two of the pumps 14 so that the total flow rate of liquid nitrogen into the well is accomplished by only a single pump 14.

Figure 2:
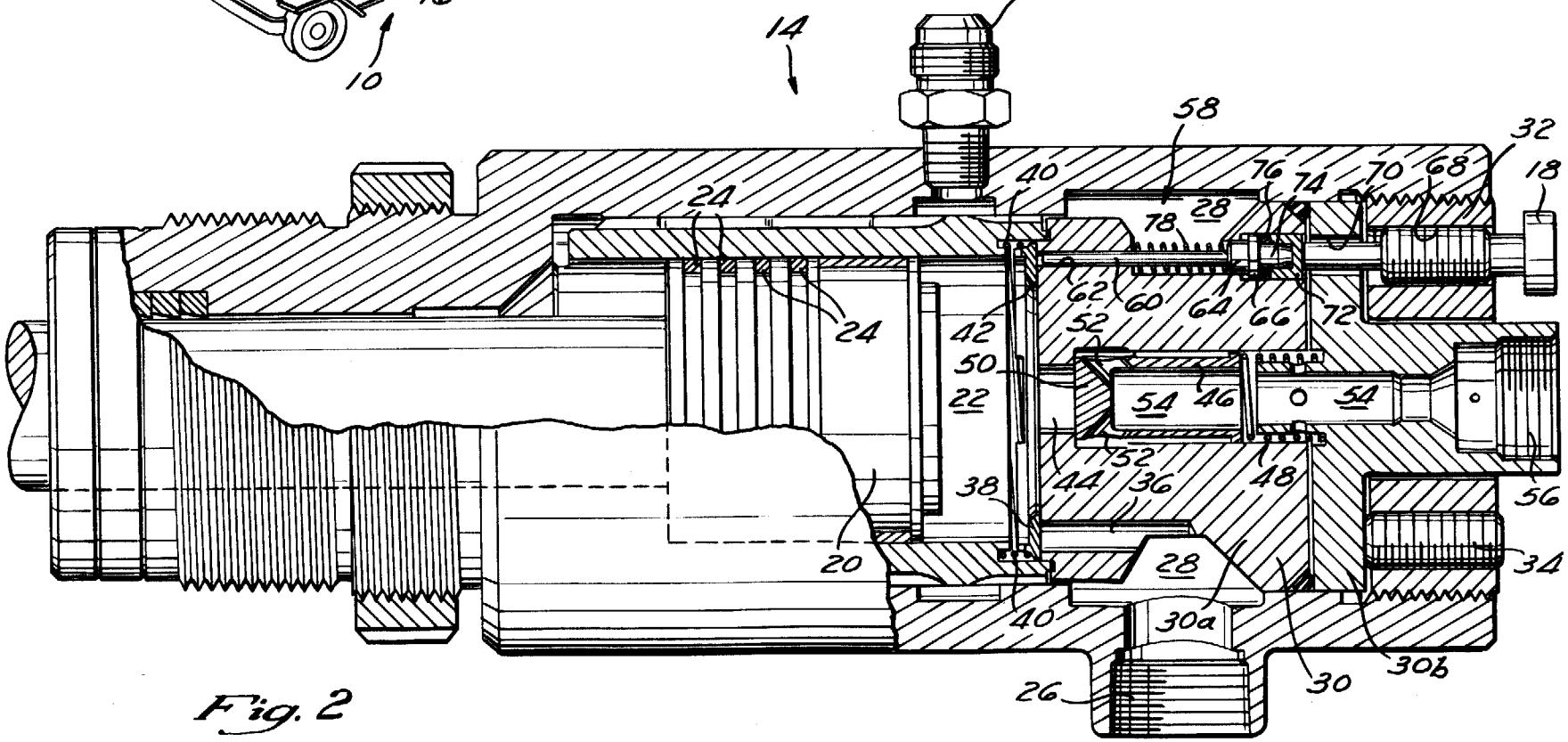
FIG. 2 is a cross sectional view of a single cylinder of a cryogenic pump illustrating the thumb screw technique for activating the unloading rod of one of the plunger assemblies of the unloading system of the present invention.

FIG. 2 illustrates in cross section the cryogenic pump 14 and the unloading system of the present invention utilized to deactivate it. The pump 14 illustrated in FIG. 2 is a positive displacement or a piston type pump which utilizes a plate valve as an inlet valve and a spring-loaded poppet valve as an outlet valve. However, the unloading system of the present invention can work as equally well in conjunction with other types of pumps and other types of valves.

The cryogenic pump 14 of FIG. 2 comprises a piston 20 which moves within a cylinder 22. The piston 20 is provided with several rings 24 which prevent liquid in the cylinder 22 from passing behind the piston 20. The cylinder 22 is vented by a valve 39 which also serves to evacuate the cylinder of gases in preparation for priming of the pump. The liquid enters the pump 14 through an inlet fitting 26 located at the bottom of the pump, and then fills an inlet annulus 28 which surrounds the head 30 of the pump. The head 30 of the pump 14 is of a two-piece construction, comprising a inner head 30*a* and an outer head 30*b*, both of which are held in place by a large jam nut 32 and several set screws 34, (one of which is shown in FIG. 2). As will be described in more detail below, one of the set screws 34 is replaced with a thumb screw 18 which is utilized, in one of embodiment of the present invention, to activate the unloading system.

Referring again to FIG. 2, the inlet annulus 28 communicates with an inlet 36 located near the base of the cylinder 22. Although only one inlet 36 is shown in FIG. 2, the pumps 14 usually have several such inlets spaced around the cylinder 22, the exact number varying with the diameter of the cylinder. For example, there may be as many as 12 inlets 36, and the cylinder diameter may range from ¾ inches to 3¼ inches, and sometimes as much as 8 inches. The inlets 36 are closed, as shown in FIG. 2, by an annular plate valve or inlet valve 38. The inlet valve 38 is lightly spring-loaded by a spring 40 in order to maintain the proper orientation of the inlet valve 38 during normal operation of the pump 14. Thus, the pressure of the liquid nitrogen in the inlet annulus 28, which operates at about 30–100 p.s.i.g., together with the reduced suction pressure created by the piston 20, is sufficient to open the inlet valve 38 and permit the free intake of liquid into the cylinder 22.

The annular construction of the inlet valve 38 permits it to simultaneously close the inlet 36 while permitting the piston 20 to force the liquid nitrogen through its large central opening 42 and into an outlet 44. The outlet 44 is closed by a poppet-type outlet valve 46. A spring 48 holds the head 50 of the outlet valve 46 against the outlet 44, thereby serving to close it. During the pressure stroke of the piston 20, the liquid nitrogen forces the outlet valve 46 open, passes through openings 52 in the side of the valve 46, and enters a discharge channel 54. The channel 54 is bored through the center of the outlet valve 46 and the inner and outer heads 30*a* and 30*b*, respectively. Eventually, the pressurized liquid exits the pump 14 through the discharge fitting 56.

Thus, in the normal operation of the pump 14, the outlet valve 46 is closed during the intake of liquid nitrogen into the cylinder 22. Both the pressure of the liquid in the inlet annulus 28 and the suction created by the piston 20 of the pump 14 opens the inlet valve 38 and permits the free intake of liquid into the cylinder 22. During the pressure stroke of the piston 20, the pressure of the liquid forces the inlet valve 38 tightly over the inlet 36 and prevents the liquid from exiting through them. Thus, the pressure of the liquid during this pressure stroke is sufficient to force the outlet valve 46 open, permiting the flow of liquid out of the outlet 44 and the discharge channel 54.

As described above, the purpose of the present unloading system is to deactivate the pump 14 and prevent the discharge of liquid from the discharge fitting 56. Preferably, the unloading system comprises three plunger assemblies 58 spaced about the periphery of the inlet valve 38 which can be utilized to hold the valve 38 open in order to deactivate the pump. Other plunger configurations can also be successfully employed.

For simplicity and clarity of description, only a single plunger assembly is shown in the cross sectional views of FIGS. 2, 3, 4, and 5. Referring first to FIG. 2, each plunger assembly 58 comprises an unloading rod 60 which is mounted in a bore 62 drilled through the inner head 30*a*. The rear end of the rod 60 is adjacent the upper portion of the inlet valve 38, while the forward end of the rod 60 is connected to a rear shoulder 64 and an unloading piston 66. When activated, the unloading rod 60 advances against the inlet valve 38 causing it to remain open during all phases of the pump's operation. Therefore, the liquid in the cylinder 22 is permitted to exit through the inlets 36 and fails to attain sufficient pressure to open the outlet valve 46. Thus, no liquid exits the discharge channel 54 and the pump 14 is successfully deactivated.

The unloading rod 60 of the plunger assembly 58 can be activated according to any number of techniques. Illustrated in FIG. 2 is a thumb screw 18, located just above the discharge fitting 56, which is utilized to manually activate the unloading rod 60. The thumb screw 18 is engaged in a threaded shaft 68 in the jam nut 32 and is in alignment with the bore 62 of the unloading rod 60. The rear portion of the thumb screw 18 extends through an opening 70 in the outer head 30*b* and engages a keeper seal 72 which is positioned around a forward shoulder 74 attached to the unloading piston 66. Inserted between the unloading piston 66 and the keeper seal 72 is an O-ring seal 76. Both of these seals 72 and 76, together with the unloading piston 66, prevent liquid in the inlet annulus 28 from exiting the pump 14 through the shaft 70 in the outer head 30*b*. The rear shoulder 64 of the plunger 58 is spring loaded, as indicated at 78.

Thus, in order to activate the unloading rod 60, the thumb screw 18 is advanced in its shaft 68 a few turns, causing its rear portion to engage the keeper seal 72 and, in turn, the forward shoulder 74. The unloading rod 60 is extended rearwardly, causing the inlet valve 38 to open. The inlet valve 38 is therefore prevented from closing over the inlet 36 during the pressure stroke of the pump's piston 20. When it is desired to return to the normal operation of the pump 14, the thumb screw 18 can be retracted, and the spring 78 causes the unloading rod 60 to return to its initial position shown in FIG. 2.

FIG. 3 illustrates a pressure differential technique for activating the unloading rod 60. In this embodiment, the plunger assembly 58 comprises an unloading rod 60 moving in a bore 62 and an unloading piston 66 which is located in a bore 63. The piston bore 63 communicates with the inlet annulus 28 by means of a small opening 80 at the forward end of the annulus 28. Thus, liquid from the inlet annulus 28 is permitted to fill the rear portion of the piston bore 63 and bear against the rear face 85 of the unloading piston 66. Because of the absence of any seals, the liquid in the bore 63 is permitted to bleed past the unloading piston 66 toward the front of the bore 63. A spring 84 is interposed between the forward face 86 of the unloading piston 66 and the outer head 30*b*.

The unloading piston 66 is provided with annular grooves 82 which collect dirt and other materials suspended in the liquid nitrogen, thereby preventing the piston 66 from binding in the bore 63. In addition, these grooves 82 also prevent the binding that may be caused by the eccentricity of the piston 66 with respect to the bore 63. That is, an eccentric piston tends to move laterally in the bore 63 in the direction of the closer tolerance, preventing the circumferential flow of the bleeding liquid and causing the piston 66 to bind up. This lateral movement is due to the unbalanced pressures acting on the piston which are, in turn, caused by the differences in liquid flow velocities past the piston. The grooves 82, however, tend to permit equal, circumferential velocities, even under eccentric piston conditions, thereby restoring balanced pressures and preventing binding.

As shown in FIG. 3, a vent line 88 for the bleeding liquid extends horizontally from the forward end of the piston bore 63 and into the outer head 30*b*. The vent line 88 then turns vertically upward through the outer head 30*b* and the casing 90 of the pump and passes through a valve 92. This vent line 88 conducts the bleeding liquid to a location 94 which is at a lower pressure than the pressure of the inlet annulus 28. Thus, the line 88 may vent the bleeding liquid to the atmosphere, or to the tank 12 of the truck 10, which is typically at 25 p.s.i.g., or to another suitable low pressure location.

During the normal operation of the pump 14, the spring 84 is in a compressed state and the valve 92 on the vent line 88 is open. Thus, in order to maintain the unloading rod 60 in its retracted position shown in FIG. 3, the pressure differential acting on the unloading piston 66 must be sufficient to maintain the spring 84 in its compressed state. Therefore, the pressure of the liquid in the inlet annulus 28 (which is also the pressure acting on the rear face 85 of the unloading piston 66) must be sufficiently greater than the pressure acting on the forward face 86 of the piston 66 (which is the pressure of the vent location 94) combined with the force of the spring 84.

When it is desired to activate the unloading rod 60, the valve 92 is closed off, thereby preventing the passage of the bleeding liquid to the vent location 94. Soon the bleeding liquid causes the pressure on the forward face 86 of the unloading piston 66 to increase. Eventually, the pressure acting on the rear face 85 of the unloading piston 66 is insufficient to maintain the spring 84 in a compressed state. The spring 84 begins to advance the piston 66 and the unloading rod 60 rearwardly toward the inlet valve 38, preventing it from closing. Thus, the pump 14 is deactivated. In order to return the unloading rod 60 to its initial, retracted position, the valve 92 on the vent line 88 is simply opened and the pressure differential across the unloading piston 66 causes it to return and compress the spring 84.

The spring 84 shown in FIG. 3 must be sufficiently strong to overcome the spring 40 acting on the inlet valve 38. As discussed above, this inlet valve spring 40 is not very strong since it is easily overcome by the suction of the piston 20. Thus, if the inlet valve 38 is held open by the unloading rod 60, no significant additional pressure is established in the cylinder 22 by the piston 20.

The pressure differential technique for activating the unloading rod 60, as shown in FIG. 3, has the advantage of eliminating any danger of damage to the inlet valve 38. That is, since the unloading rod 60 is gradually advanced in its bore 62 by the spring 84, the valve 38 is not damaged by attempting to close on a protruding unloading rod. In essence, the rod 60 follows the inlet valve 38 as it opens during the intake of liquid into the cylinder 22. This same advantage can also be accomplished in the manual thumb screw system illustrated in FIG. 2 by slowly advancing the thumb screw 18 in order to cause the unloading rod 60 to engage the inlet valve 38 gradually, or by inserting a compression spring between the thumb screw 18 and the seal 72.

FIG. 4 illustrates a variation of the pressure differential technique for activating the unloading rod which is illustrated in FIG. 3. In this embodiment, the high and low pressure sides of the unloading piston 66 and the location of the spring 84 are reversed. Thus, rather than being a vent line, line 88 is connected to a high pressure source 96 which is closed off by the valve 92 during the normal operation of the pump 14. In order to activate the unloading rod 60, the valve 92 is opened and the high pressure source 96 forces the unloading piston 66 toward the rear, compressing the spring 84. To retract the rod 60, the valve 92 is closed and the spring 84 causes the piston 66 to return to its initial position. Thus, the pressure of the source 96 must be sufficient to overcome the pressure of the liquid in the inlet annulus 28 and that of the springs 84 and 40.

An electronic technique for activating the unloading rod 60 is illustrated in FIG. 5. In this embodiment, the unloading rod 60 is again mounted in a bore 62 drilled in the inner head **30*a* and is aligned with the peripheral portion of the inlet valve 38. However, this bore 62 is also large enough to accomodate a cylindrical solenoid 98 which surrounds the unloading rod 60. The unloading rod 60 acts as an armature so that when the solenoid 98 is energized by means of wires 100, the rod will be advanced in the bore 62 and engage the inlet valve 38 in order to open it. A piston 102 is mounted on the opposite end of the unloading end of the unloading rod 60 and is provided with a return spring 104. One particular advantage of this unloading system is that the unloading rod 60 can be activated remotely, such as at the control panel of the transporting truck 10** or other transporting vehicle.

It is also possible to activate the unloading rod hydraulically. In such an embodiment of the present invention, it is only necessary to sufficiently insulate the hydraulic fluid from the liquid nitrogen in the cylinder so the fluid is not frozen.

What is claimed is:

1. An unloading system for deactivating a pump, comprising:

a chamber;

an inlet valve for admitting a liquid into said chamber, said liquid having an inlet pressure;

means in said chamber for pumping said liquid, an outlet valve for discharging said liquid from said chamber; and means responsive to said inlet pressure for selectively opening said inlet valve during the pumping of said liquid to prevent said liquid from being discharged through said outlet valve.

2. The unloading system of claim 1 wherein said opening means comprises means for preventing said inlet valve from closing.

3. The unloading system of claim 2 wherein said preventing means is activated in accordance with a pressure differential acting on said preventing means.

4. An unloading system for deactivating a pump, comprising:

a chamber;

an inlet for admitting a liquid into said chamber;

an inlet valve for closing said inlet;

means in said chamber for pumping said liquid;

an outlet valve for discharging said liquid from said chamber, said liquid having a discharge pressure; and means responsive to a pressure independent of said discharge pressure for engaging said inlet valve and preventing said inlet valve from completely closing said inlet.

5. The unloading system of claim 4 wherein said inlet valve comprises a plate valve and said engaging means comprises plunger means for interfering with the closure of said inlet valve over said inlet.

6. The unloading system of claim 5 wherein said plunger means is activated in response to a pressure differential across said plunger means.

7. The unloading system of claim 6 wherein a pressure on one side of said plunger means is that of said liquid at said inlet.

8. An unloading system for a cryogenic pump, comprising:

a pumping chamber;

means located in said chamber for pumping a cryogenic liquid;

an inlet for admitting said cryogenic liquid into said chamber, said cryogenic liquid having an inlet pressure;

an outlet for discharging said cryogenic liquid from said chamber;

inlet valve means for covering said inlet; and unloading means for selectively (i) holding said inlet valve means open to prevent said cryogenic liquid from exiting through said outlet, and (ii) permitting said inlet valve means to close said inlet so that said cryogenic liquid is pumped out of said outlet, said unloading means being responsive to a pressure differential formed between said inlet pressure and an external pressure source.

9. An unloading system for a cryogenic pump for preventing the discharge of a cryogenic liquid from said pump during the continuous operation of said pump, comprising:

a pumping chamber;

an inlet for admitting said cryogenic liquid into said pumping chamber;

an outlet for discharging said cryogenic liquid from said chamber;

means in said chamber for pumping said cryogenic liquid through said outlet;

an annular valve for covering said inlet;

a selectively extendable plunger for opening said annular valve to prevent said cryogenic liquid from being discharged from said chamber through said outlet, said plunger being activated by a higher pressure independent of the pressure of said cryogenic liquid.

10. An unloading system for a pump, comprising:

a chamber;

an inlet valve for admitting a liquid into said chamber, said liquid having an inlet pressure;

means in said chamber for pumping said liquid;

an outlet valve for discharging said liquid from said chamber;

piston means for opening said inlet valve to prevent said liquid from being discharged through said outlet valve; and a pressure differential acting on said piston means for selectively operating said piston means, said pressure differential comprising said inlet pressure and a lower pressure independent of the pressure of said liquid.

11. The unloading system of claim 10 further comprising:

an independent force acting on one side of said piston means; and means for externally regulating said low pressure.

12. The unloading system of claim 11 wherein said means for regulating said low pressure comprises means for (i) increasing said low pressure, said independent force causing said piston means to open said inlet valve and (ii) decreasing said low pressure, said pressure differential causing said piston means to permit said inlet valve to close.

13. The unloading system of claim 11 wherein said inlet pressure causes said cryogenic liquid to bleed across said piston means.

14. The unloading system of claim 13 wherein said means for regulating said low pressure comprises means for controlling the venting of said bleeding liquid.

15. The unloading system of claim 11 wherein said force is a spring.

16. An unloading system for a pump, comprising:

a chamber;

an inlet valve for admitting a liquid into said chamber;

means in said chamber for discharging said liquid;

an outlet valve for discharging said liquid;

armature means for opening said inlet valve to prevent said liquid from being discharged from said chamber through said outlet valve; and solenoid means activating said armature means, said solenoid means being manually activated regardless of the pressure of said liquid.

17. An unloading system for a pump having an inlet valve for admitting a liquid at an inlet pressure into said pump, said unloading system comprising:

a bore;

an unloading rod for moving in said bore and engageable with said inlet valve;

means for biasing said rod against said inlet valve to prevent said inlet valve from closing;

a piston bore communicating with said inlet pressure, said inlet pressure providing pressure differential means for preventing said rod from engaging said inlet valve to permit said inlet valve to close;

an unloading piston coupled to said unloading rod and located within said piston bore to react to said inlet pressure; and means for selectively decreasing said pressure differential to permit said biasing means to cause said rod to engage said inlet valve and prevent said inlet valve from closing, thereby unloading said pump.

18. An unloading system for a pump having an inlet valve for admitting a liquid at an inlet pressure into said pump, said unloading system comprising:

means for engaging said inlet valve;

means for biasing said engaging means against said inlet valve;

pressure differential means for biasing said engaging means away from said inlet valve, said pressure differential comprising (i) said inlet pressure and (ii) a location at a lower pressure.

19. The unloading system of claim 18 further comprising means for activating said unloading system, said activating means comprising means for selectively increasing or decreasing said pressure differential.

20. The unloading system of claim 19 wherein said pressure differential causes said liquid being pumped to bleed past said engaging means and to vent to said lower pressure location, said activating means comprising means to regulate said venting of said bleeding liquid.

21. The unloading system of claim 18, further comprising:

a cylinder;

piston means coupled to said engaging means for moving in said cylinder; and means on said piston means for maintaining alignment of said piston means in said cylinder.

* * * * *